US007775493B2

(12) United States Patent
Pilutti et al.

(10) Patent No.: US 7,775,493 B2
(45) Date of Patent: Aug. 17, 2010

(54) DECORATIVE ARTICLE

(76) Inventors: Theresa Marie Pilutti, 5303 Magnolia Green Ln., League City, TX (US) 77573; Michael Grant Collins, 5303 Magnolia Green Ln., League City, TX (US) 77573

( * ) Notice: Subject to any disclaimer, the term of this patent is extended or adjusted under 35 U.S.C. 154(b) by 757 days.

(21) Appl. No.: 11/392,859

(22) Filed: Mar. 29, 2006

(65) Prior Publication Data

US 2007/0228250 A1 Oct. 4, 2007

(51) Int. Cl.
*A47H 1/10* (2006.01)

(52) U.S. Cl. ..... 248/261

(58) Field of Classification Search ..... 248/261, 248/262, 534, 539; 206/5; 229/122; 239/57; 47/41.04–41.15; 211/69.1, 69, 71.01, 60.1; 220/676, 476, 480, 801, 796; 403/174, 178; D11/143, 146, 147

See application file for complete search history.

(56) References Cited

U.S. PATENT DOCUMENTS

| | | | | |
|---|---|---|---|---|
| 673,412 | A | | 5/1901 | Baker |
| 789,390 | A | | 5/1905 | Smith |
| 929,923 | A | | 8/1909 | Drinkus |
| 1,030,205 | A | | 6/1912 | Peplowski |
| 1,234,730 | A | * | 7/1917 | Chapman ..... 220/676 |
| D82,173 | S | * | 9/1930 | Osbrink ..... D11/147 |
| D169,077 | S | * | 3/1953 | Mains, Jr. ..... D6/469 |
| 2,637,299 | A | * | 5/1953 | Salkey ..... 206/214 |
| 2,824,651 | A | * | 2/1958 | Davis ..... 211/69 |
| 3,273,701 | A | * | 9/1966 | Friedman ..... 206/742 |
| 5,282,505 | A | | 2/1994 | Gilley et al. |
| 5,584,403 | A | * | 12/1996 | Sipperly ..... 211/63 |
| D404,995 | S | | 2/1999 | Jaggi et al. |
| D404,999 | S | | 2/1999 | Jaggi et al. |
| 6,363,994 | B1 | | 4/2002 | Roberts et al. |
| D489,960 | S | * | 5/2004 | Grendahl ..... D8/354 |
| 2003/0164432 | A1 | * | 9/2003 | Shea ..... 248/220.31 |
| 2006/0065667 | A1 | * | 3/2006 | Martin et al. ..... 220/676 |

* cited by examiner

*Primary Examiner*—Ramon O Ramirez

(57) ABSTRACT

A multi-functional decorative article having a body and three or more apertures in the body, wherein two or more apertures are continuous with each other within said body, whereby the apertures can be used to support and arrange products, mainly window treatments, in a variety of decorative arrangements; the optional coverings for the apertures can be used to support products and arrange products; and the optional fasteners can be used to fasten products to the body.

17 Claims, 3 Drawing Sheets

DECORATIVE ARTICLE

FIELD

The embodiments of this invention relate to window treatments and home decorating.

BACKGROUND

Homeowners decorate their rooms to create a desired ambience and to beautify the appearance of each room for the occupants and their visitors. Room decor affects the mood of those who enter each room. Homeowners and decorators appreciate the proper use of color, space, creativity, and textures to attain the desired atmosphere and beauty.

Decorating, like other artistic expressions, follows distinct trends, but there is also an element of individual expression that can be exhibited while following decorating trends. A current home decorating trend is the imaginative use of window treatments to achieve a variety of practical and decorative purposes.

Window treatments are used to decorate or cover windows. Some of the common window treatment products are corbels, cornices, rods, beams, swags, valances, blinds, finials, rings, sconces, hooks, tiebacks, brackets, swagholders, shutters, screens, pelmets, scarves, drapes, shades, and cascades.

A corbel is a structural support article that is generally mounted to the wall near a window. A set of corbels, one on each side of a window, usually supports a rod or beam between the two corbels, the rod or beam supports the swags, valances, blinds, tiebacks, pelmets, scarves, drapes, shades, and cascades.

Corbels have a body with one opening passing completely through the body. There are many decorative designs of corbels available, but they are structurally similar. Corbels are usually mounted so that the opening has a horizontal orientation. While a variety of products can be directly or indirectly supported by the corbels, the corbels have limited functionality and limited application.

Today's home designers and manufacturers place windows in homes for different practical and aesthetic purposes. Large plate glass windows offer good visibility, but do not survive impacts well or hurricane force winds. Small glass windows have decreased visibility, but they survive soft impacts and high winds better than large plate glass windows.

For whatever reason, some home manufacturers are making homes using many small windows adjacently placed in vertical and horizontal arrangements, instead of using large plate glass windows. Sometimes these window arrangements occupy more wall space than a plate glass window. The practical result for using many small windows, instead of using one large window, may be less wall space for window treatment supports and more window space to elaborately decorate in imaginative ways.

Due to the changes in window placement and the decorative use of window treatments, homeowners and decorators need decorative articles that have more functional capabilities, while still being aesthetically attractive. What is disclosed is a decorative article that can be used to achieve a variety of practical and decorative purposes.

SUMMARY

The present invention is directed to a decorative article that provides decorators with more product support and arrangement options. The decorative article has a body with three or more apertures in the body, wherein two or more apertures are continuous with one another within the body.

The decorative article can be directly or indirectly affixed to a support surface. A support surface is a wall, post, beam, ceiling, frame, or any part of a building. The decorative article can be affixed in a variety of positions relative to a wall opening, doorway, or window. The decorative article can be suspended in a room from one or more support surfaces. While most decorators will affix the article so that the apertures are oriented vertically and horizontally, the article can be affixed so that the apertures are oriented at other angles.

A pair of decorative articles will usually be affixed near a wall opening, doorway, or window with one article on each side, left and right, of the wall opening, doorway, or window. Once affixed, the two decorative articles provide support to and positioning for other products, mainly window treatments. Usually a rod or beam will be positioned between the horizontal apertures of the affixed decorative articles. Products can be placed into the apertures of the body of the article.

This decorative article may have several optional features that serve both practical and decorative purposes. Some of the optional features are collapsible sides, various coverings for the apertures, an interior cavity within the body, and fasteners for the products. The coverings for the apertures provide many different functional features to the article, such as blocking apertures, changing the shape of the apertures, making apertures smaller, hiding apertures, decorating apertures, and supporting other products.

The body of the article can have different shapes and sizes. While the body of the article will usually have a substantial and continuous external surface with apertures interrupting that external surface, the body can be made with little external surface. A body can be made using a long metal rod that is bent and made into a body with apertures, such a body would lack a substantial or continuous external surface.

An aperture is a knockout piece or an opening in the body of the article. The apertures of the body can have different shapes and sizes. The apertures in the body of the article can have many different orientations. Some apertures of the body can support rods and beams. Some products can be placed within the apertures of the body.

A body with collapsible sides is designed to collapse for packaging, storing or shipping. To make the body collapse, the body can be wholly made of flexible and partially elastic material or several joints of the body can be flexible. For box-shaped bodies, some of the joints can flex with opposing angles either increasing or decreasing and the sides not having flexing joints can either dislodge or flex with the collapsing motion. To make such a body maintain its uncollapsed shape, one or more braces may be used to immobilize the collapsing sides.

A covering is a lid, cover, cap, barrier, top, plate, insert, stopper, or plug. The article has many different coverings available for use. The covering chosen or used depends on the purpose of the decorator. Some of the embodiments have coverings to hide and block the apertures when the apertures are not being used to hold products. Some of the embodiments have a covering that hides an aperture and that covering can support another object. Some of the embodiments have a covering that hides an aperture, but that covering has a smaller aperture in the covering, thus decreasing or altering the shape of the aperture.

Those embodiments having coverings that decrease the size or alters the shape of the apertures can be used to receive products that are smaller or have different shapes. Some of the embodiments have a covering that hides an aperture and that covering has an aperture in the covering, thus decreasing the size or altering the shape of the aperture, and that covering can support another object. This is a preferred feature.

Some of the embodiments have two or more coverings that hide apertures, but those coverings have smaller apertures in the coverings, thus decreasing the size or altering the shape of the apertures. Some preferred embodiments have one or more coverings that decrease the size or alter the shape of the apertures.

Some of the embodiments have decorative coverings to hide apertures. The coverings for the apertures can have different shapes and sizes. Some of the coverings have a plug feature that is made to tightly fit into the corresponding aperture of the body. When the plug feature is pushed into the aperture, the plug feature holds the covering in place and the aperture is covered by the covering. The coverings with the plug feature are a preferred feature. The plug feature can be made of cork, rubber, or polymer.

The body of the article can have an interior cavity that is larger than the openings formed by the apertures. The body of the article can lack an interior cavity other than the openings formed by the apertures. The interior cavity can have different shapes and sizes. A body that has an interior cavity is a preferred feature as it allows more space within the body of the article for products to occupy.

Some of the embodiments have fasteners on or within the body of the article to hold products in place. A fastener is a bolt and nut, screw, cinch, harness, anchor, thread insert, ring, rivet, clamp, clip, pin, nail, wedge, vice, grip, claw, key, knots, splices, hook and loop tape, plug, grommet, latch, buckle, hasp, connector, staple, hook, eye, magnet, cable, ties, soldering, welding, surface tension, epoxies, button, buttonhole, or adhesives. Embodiments having fasteners within the body of the article and near the apertures are preferred to the fasteners being placed on the exterior of the body.

Because the article has several different features available and multiple apertures available for arranging products, the article can be used in many different ways. Some of the apertures can be used for receiving and supporting rods and beams. The supported rods and beams can be used to hold and arrange other products, like window treatments.

The article is uniquely useful when arranging flexible products, like drapes, scarves, and swags. In some embodiments, some products can be placed into one aperture so that the end of the product occupies the body of the article. Some products can be placed into a first aperture and continue out of the body through a second aperture.

In some embodiments, some products can be placed into a first aperture, continue out of the body of the article though a second aperture, be folded back through the second aperture for decorative effect, and then the end of the product can occupy the body of the article. In some embodiments, some products can be placed into a first aperture, continue out of the body of the article though a second aperture, be folded back through the second aperture for decorative effect, and then continue out of the body of the article through an aperture.

There are many possible ways to arrange products using the article. Two or more products may be placed into one or more apertures of the body and then exit the body together through an aperture. Several products may be placed into an aperture of the body and then exit the body through more than one aperture.

The decorative article can even be used to support other decorative articles. In this application, four or more decorative articles may be used for one set of windows, doorways, or wall openings. The extra decorative articles can be used for arranging additional products or they can support and stabilize other decorative articles.

This flexibility in how the article can be used allows the article to be used in situations where other decorative and window treatment articles would not suffice. The article is capable of holding multiple products in small corners or small spaces within residences. The article is capable of holding different types of products simultaneously. The article allows for decorative arrangement options that do not exist in other decorative articles or window treatment articles.

Two kits are claimed. The first kit is an article and a means for affixing the article to a support surface. The second kit claim includes an article where the body has an interior cavity and a means for affixing the article to a support surface.

Some of the embodiments have many of the different features of the other simpler embodiments incorporated within a single article. Some of the embodiments have most of the different features of the other simpler embodiments incorporated within a single article.

Some of the features that are found in the more preferred embodiments are four to five apertures; an interior cavity; an upper planar covering having an aperture in the covering and that covering is capable of supporting an object that will not fall through the aperture in the covering; two side coverings, left and right, having a plug feature; a lower covering that has a slot shaped aperture in the covering; and possibly two fasteners affixed to the body to receive products from each of the side apertures.

These and other features, aspects, and advantages of the present invention will become better understood with regard to the following description, appended claims, and accompanying drawings.

DESCRIPTION

Figure 1:
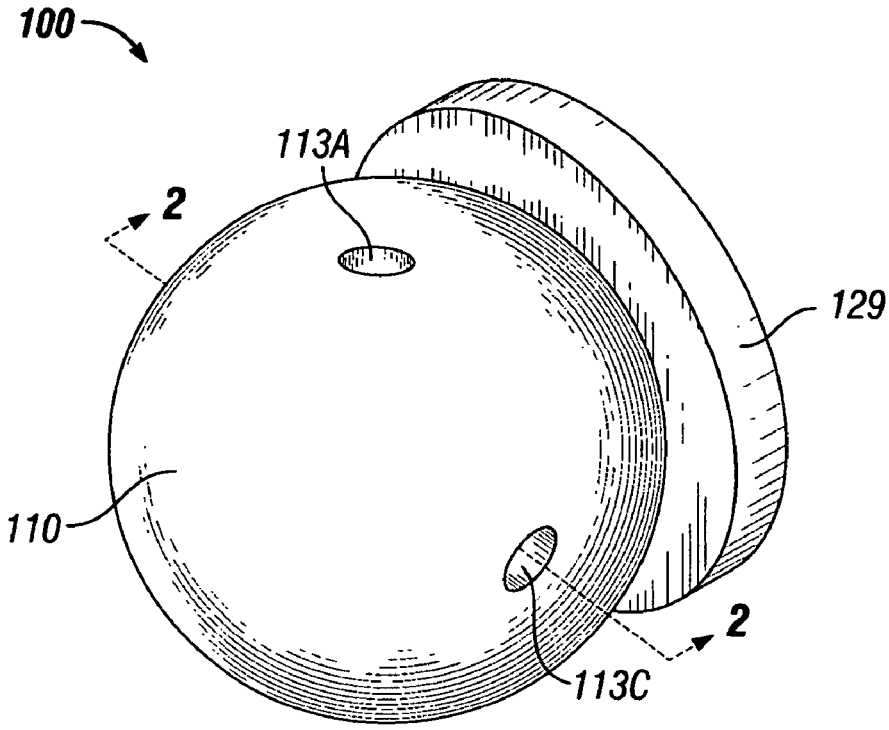
FIG. 1 shows a downward front and right side perspective view of an embodiment having a nearly spherical-shaped body with four apertures (two apertures not shown), an interior cavity (not shown), a screw (not shown), and a wall mounting surface on the back side of the body.

In accordance with some embodiments, described herein, a decorative article is disclosed. Many of the words used in the specification and claims are defined in the next six paragraphs.

A body is defined as an object and this object does not have to have a solid, substantial, or continuous exterior surface to be a body. Window treatments are products used to decorate or cover windows. A product is any product and it expressly includes window treatments. The article can be used to support and arrange many different products.

A knockout piece is defined as a portion of the surface of the body which has boundaries formed by a preformed indentation or partial cutting in the surface of the body. The knockout piece can be removed later usually by cutting or exerting force upon the knockout piece, thus leaving an aperture in the body. An aperture is defined as a knockout piece or opening in the body of the article and if an opening is continuous through the body, then that opening consists of two opposing apertures in the body.

A covering is a lid, cover, cap, barrier, top, plate, insert, stopper, or plug. A fastener can be a means for affixing so the listed fasteners are a means for affixing. A fastener is a bolt, nut, toggle bolt, screw, cinch, harness, anchor, thread insert, ring, rivet, clamp, clip, pin, nail, wedge, vice, grip, claw, key, knots, splices, hook and loop tape, plug, grommet, latch, buckle, hasp, connector, staple, hook, eye, magnet, cable, ties, soldering, welding, surface tension, epoxies, button, buttonhole, or adhesives. An interior cavity is defined as a cavity in the body that occupies more space than the cavity formed by the continuation of the apertures of the body.

A support surface is a wall, post, ceiling, beam, frame, or any part of a building. Indirect affixation is where an object or objects are placed between the article and the support surface. A means of affixing includes fasteners, direct affixation, and indirect affixation.

The "back" of the article is the portion of the article that is closest to the support surface. The "front" of the article is the portion of the article that is opposing the back of the article. The "right" or "right side" of the article is the portion of the article that is on the right side of the article when viewing the article from the front.

The "left" or "left side" of the article is the portion of the article that is on the left side of the article when viewing the article from the front. The "upper," "upward," or "upper side" of the article is the portion of the article that is on the top side when viewing the article from the front. The "lower," "downward," or "lower side" of the article is the portion of the article that is on the bottom side when viewing the article from the front.

Where the article is suspended from one or more support surfaces, references to "front," "back," "left," and "right" can only be made in reference to the article as if the article was affixed, in an unsuspended manner, to a support surface.

The decorative article, as disclosed herein, has a body with three or more apertures in the body and two or more apertures in the body are continuous with each other within the body. The decorative article has many different embodiments. These embodiments can have different shapes, different sizes, and many different features or combinations of features.

The body of the decorative article can have different shapes and sizes. The body of the article can be made from wood, metal, glass, ceramic, polymer, composite, and other materials. Wood, metal, polymer, or composite pieces may be made into the desired shape and assembled using glue, welding (for metal only), screws, or nails. A liquefied material for the body can be poured into a mold and then cooled or set awaiting solidification. The body can be made by using glassblowing techniques to form the body.

While the article can be made with a substantial exterior surface to the body, it is not the only way to form the body and satisfy the claims. The article could be formed using a long round metal bar that is bent and made into the article, as defined by the claims.

The apertures in the body of the article can have different shapes and sizes. The apertures in the body can be established before the body is made by preforming the materials. The apertures in the body can be established while the body is made by pouring the liquefied material into a mold that has the apertures present in the mold. The apertures in the body can be established after the body is made by cutting, boring, or by removing knockout pieces in the body.

The apertures can receive and support products, including rods and beams. The apertures can also receive and support products, including window treatments. The size of an aperture can be decreased by using a covering with a smaller aperture in the covering. The shape of an aperture can be altered by using a covering that has a different shaped aperture in the covering. This allows decorators more flexibility in arranging products.

The body of the article can be directly or indirectly affixed to a support surface. The body is usually affixed near a window, a doorway, or other wall opening with one body on each side, left and right, of the window, doorway, or other wall opening. The body can be indirectly affixed to a support surface by affixing it to a rope, chain, cable, frame, mounting plate, or bracket.

The body can be rotated to a particular orientation just prior to affixing the body to a support surface, so that the apertures can be at the desired orientations to receive the products. The preferred orientation of the apertures is vertical and horizontal on four apertured bodies. The preferred orientation of the apertures for three apertured bodies is two apertures in a horizontal orientation and one aperture in a downward vertical orientation.

The embodiments may be affixed in many different orientations of the apertures and still be useful. Having more apertures in the body allows for more possible decorative arrangements. Too many apertures in the body may make the article aesthetically displeasing or the size of the apertures may become too small to receive products.

The body of the article can have an interior cavity or lack an interior cavity. The interior cavity can have different shapes and sizes. An interior cavity is additional space within the body that is not provided by the continuation of the apertures.

The embodiments that lack an interior cavity can be used to receive products that do not need to occupy a large volume within the body of the article. The embodiments that have an interior cavity can be used to receive products that may or may not continue through the body of the article.

There are several useful advantages to having a body with an interior cavity. The end of a product may be wholly stored in the interior cavity of the body. A substantial portion of a product may be stored in the interior cavity of the body, so that only a small portion of the product extends out another aperture. The product may be placed into one aperture, pass through the interior cavity, and exit another aperture.

Another way of using the embodiment having an interior cavity is to bring the product through one aperture; continue the product through the interior cavity and another aperture, thus exiting the body of the article; and then arrange the product so it continues back through the last aperture that it just went through when exiting the body of the article.

The interior cavity is a place where a means of fastening may be housed out of sight and still function properly to fasten products in a particular position. An interior cavity allows space for fingers to move within the body when arranging or fastening products. The interior cavity is an optional and preferred feature.

Coverings serve several aesthetic and practical purposes. The coverings for the apertures in the body can have different features, different shapes, and different sizes. The same aperture can have different coverings that can be applied to it for different purposes. A solid covering applied to an aperture can block and hide that aperture. A decorative covering applied to an aperture can hide an aperture so that observers only see the decorative covering, not the aperture.

The coverings can have apertures in the coverings. The coverings that have apertures in the covering can decrease the size of or alter the shape of the aperture. The coverings with apertures in the covering that decreases the size of the aperture can be used to receive smaller products. The coverings with apertures in the covering that alters the shape of the aperture can be used to receive different shaped products.

The coverings with apertures in the coverings can have apertures that are shaped like a slot. The coverings with apertures in the coverings can change a rectangular-shaped aperture into a circular-shaped aperture, and vice versa. The coverings with apertures in the coverings will allow decorators to use different textures and different thicknesses of products with the decorative article.

A planar covering can be used to support an object when the planar covering is positioned to block an upper aperture on one of the embodiments. A covering that is planar and has an aperture in the covering can be used for receiving products. When a planar covering with an aperture in the covering is positioned to block an upper aperture on one of the embodiments, the planar covering can be used to support an object that will not fall through the aperture. A planar covering on the upper aperture with a small aperture in the covering is a preferred feature.

A covering can be held in place in many different ways. The covering can have a feature on it that causes it to affix to the body around the aperture or to the aperture. A covering could use hook and loop tape to affix to the body around the aperture. The coverings can have a plug feature. The plug feature of the coverings should be made to fit one or more apertures of the body so that the plug feature can hold the covering on the body when the plug is inserted into the aperture.

A covering can slide into a premade slot on or within the body of the article. The covering can rest on the body when it is blocking an aperture. The covering can rest on a premade shelf on or within the body of the article. Coverings that cover opposing apertures can be applied using an elastic material, the elastic material can be hooked onto opposing hooks that are attached to the inside surface of the coverings. Coverings that cover opposing apertures can be applied using a spring, the spring can be hooked onto opposing hooks that are attached to the inside surface of the coverings.

The coverings can be held in place on the body using magnets, where one surface has an affixed magnet and the other surface has an affixed ferromagnetic metal. A covering can be held in place by using clips. The clips on the body can grasp a feature of the covering. Clips affixed to the covering can grasp a feature of the body. There are many possible ways of revocably affixing the coverings to the aperture or body of the article.

Fasteners hold the products in particular positions on or within the body itself. When the fastener is attached to the product, this may make the fastening of the product nearly unadjustable so the product can be fastened in only a limited number of ways. When the fastener is attached to the body, the product can be positioned and fastened according to the desires of the decorator.

While a fastener can be attached to the product and the fastener can be fastened to the body, it is more desirable to attach the fastener to the body of the article and then fasten the product to the body. It is preferable to attach the fastener to the body and then fasten the product.

The fastener or fasteners can be attached to the body on the inside or outside of the body. The preferred method of attachment is to attach the fasteners to the inside of the body so that the fasteners are out of sight. It is particularly desirable to use fasteners with embodiments that have an interior cavity. A large interior cavity within the body provides more space for the fasteners.

When the fasteners are inside the body, the fasteners can be positioned near one or more apertures to make the fasteners more accessible for fastening and unfastening. Fasteners are an optional feature. The fasteners can be bolts, nuts, clamps, toggle bolts, clips, pins, nails, wedges, vice, grips, claws, hook and loop tape, hooks, eyes, magnet, soldering, welding, surface tension, epoxies, buttons, buttonholes, and adhesives.

Soft window treatments are flexible window treatments, such as drapes and scarves. Hard window treatments are nearly inflexible window treatments, such as rods, corbels, and beams. Methods for fastening soft window treatments may be different than the methods for fastening hard window treatments.

The soft window treatments can be fastened by applying the fastener to the material of the window treatment. It is particularly desirable to use a fastening means that does not physically harm the soft window treatment. Hook and loop tape, gentle clips, or gentle clamps are preferable for soft window treatments. The method of fastening chosen may change with different consistencies of soft window treatments.

The hard window treatments can be fastened using stronger fasteners than that used on soft window treatments. Stronger clips, stronger clamps, bolts, pins, or screws can be used to fasten hard window treatments.

Two kits are claimed. The first kit includes a body with three or more apertures in the body, wherein two or more apertures are continuous with one another within the body, and a means for affixing the body to a support surface. The second kit claim includes a body having an interior cavity, said body having three or more apertures in the body, wherein two or more apertures are continuous with the interior cavity within the body, and a means for affixing the body to a support surface.

In some embodiments, the article may be affixed using a flat surface on the back of the article through which a means for affixing attaches the article to the support surface. In some embodiments, the article may be affixed to one or more support surfaces using rope, chain, or cable to suspend the article within a room.

Some embodiments may be collapsible by using flexible materials or flexible joints in the body of the article. The parts of the collapsible body may be made rigid by installing a brace or braces within the body so the flexible corners are immobilized. The flexible corners can be made using hinges, flexible materials, bands, rubber, or soft polymer.

In FIG. 1, the embodiment 100 is viewed from a downward front and right perspective, the embodiment 100 has a spherical-shaped body 110, four circular-shaped apertures (113A (upper), 113B (lower and not shown), 113C (right), and 113D (left and not shown)), a spherical interior cavity 115 (not shown), two fastening clips (not shown) 127D and 127C, a circular shaped mounting surface 129, and a screw 123 (not shown) for affixing the body 110 to a support surface through the mounting surface 129. The dotted line 2 that proceeds through the centers of apertures 113C and 113D (not shown) represents the sectioned view.

Figure 2:
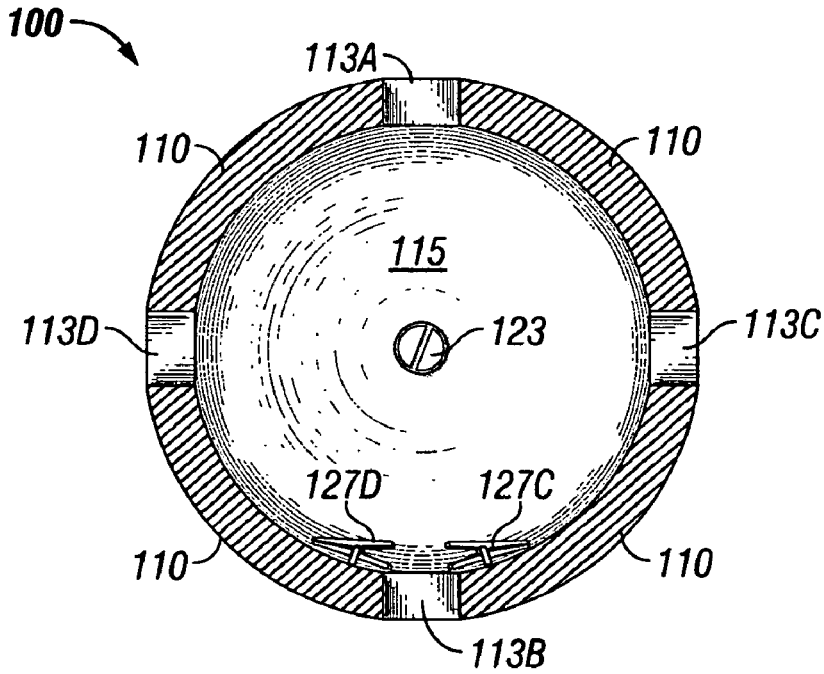
FIG. 2 shows how a cross-section of the spherical-shaped body of FIG. 1 would appear, in this view the interior cavity and all four apertures, as cross-sectioned, are visible, fastening clips are visible near the lower aperture, and the head of a screw is visible.

In FIG. 2, a cross-section of the embodiment 100 of FIG. 1 is depicted with the sectioning passing through the centers of the apertures (113A (upper), 113B (lower), 113C (right), and 113D (left)), the body 110, and the interior cavity 115, the fastening clips 127C and 127D are shown inside the interior cavity 115 and near the aperture 113B for easy access, and the head end of the screw 123 is shown, the screw 123 is a means for affixing the body 110 to a support surface through the mounting surface 129.

If embodiment 200 was made the same size as embodiment 100, then embodiment 200 would have an external appearance that looks like embodiment 100, as depicted in FIG. 1. From the outside, embodiment 200 has a spherical shaped body 210 (not shown), like the spherical shaped body 110 of embodiment 100, and a circular shaped mounting surface 229 (not shown), like the mounting surface 129 of embodiment 100.

Figure 3:
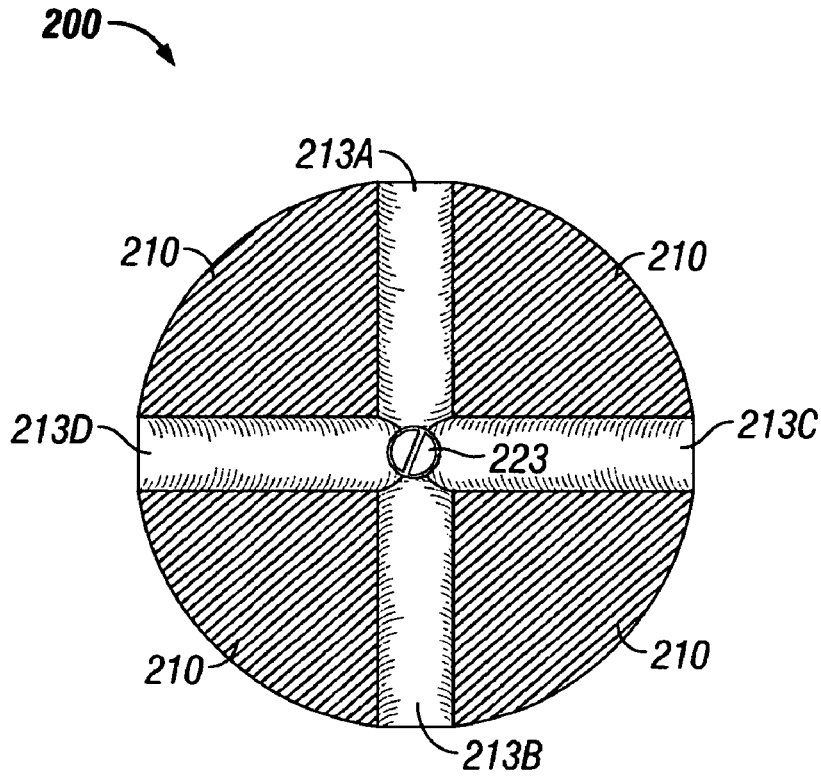
FIG. 3 depicts how a cross-section of a spherical-shaped body that lacks an interior cavity and lacks fastening clips, having four apertures, and a screw would appear.

In FIG. 3, a cross section view depicting the back half of embodiment 200 shows that embodiment 200 lacks an interior cavity, lacks fastening clips, and the screw 223 that affixes embodiment 200 to a support surface is longer than the screw that affixes embodiment 100 to a support surface. Embodiment 200 has a spherical shaped body 210, four circular shaped apertures (213A (top), 213B (lower), 213C (right), and 213D (left)), a circular shaped mounting surface 229 (not shown), and a screw 223.

Embodiment 200 is made by pouring a liquefied material into a mold, the mold is shaped for the body 210, the apertures (213A, 213B, 213C, and 213D), the mounting surface 229, and the mold has the screw 223 in place when the liquefied material is poured, when the embodiment 200 sets, the body 210 is nearly solid and the screw 223 is ready to be affixed to a support surface by rotating the embodiment 200 so that the screw enters the support surface.

Figure 4:
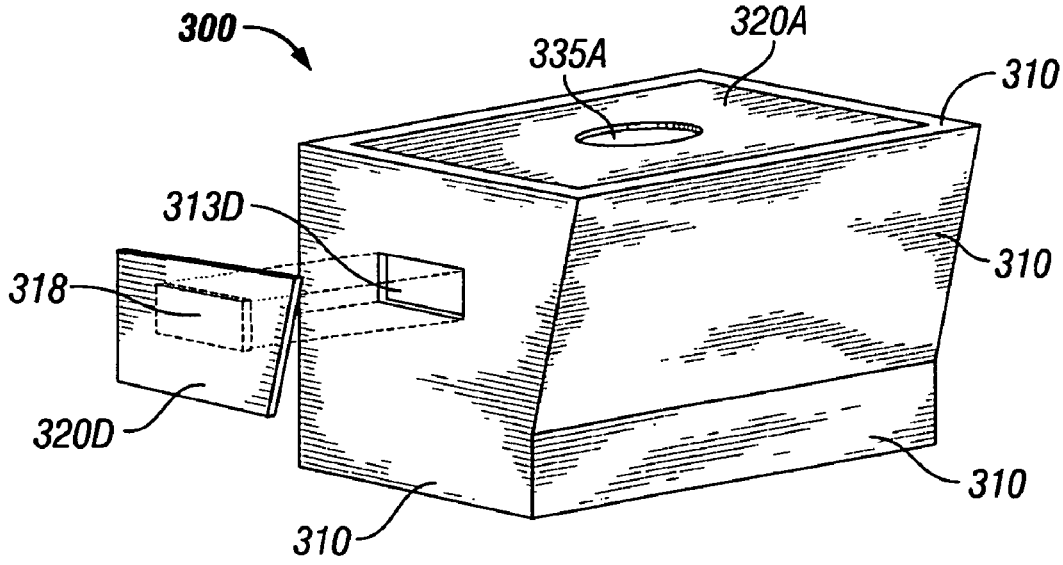
FIG. 4 depicts a front and left perspective view of a preferred embodiment having a body with five apertures in the body, not visible, two mounting slots (not shown), and four coverings, a rectangular-shaped upper covering having a circular-shaped aperture in the covering, rectangular shaped lower covering having a slot shaped aperture (not shown), and two right trapezoid-shaped coverings, left (shown) and right (not shown)

Is In FIG. 4, a front left perspective view of a preferred embodiment 300 is depicted, embodiment 300 has a body 310, five rectangular shaped apertures 313A (upper, not shown, as its view is blocked), 313B (lower, not shown), 313C (right, not shown), 313D (left), and 313E (back, not shown), two rectangular coverings 320A (upper) having a circular shaped aperture (335A) in the covering and 320B (lower, not shown) having a slot shaped aperture (335B) in the covering, a right trapezoid shaped covering 320C (right, not shown) having a rectangular shaped plug feature 318 (not shown), a right trapezoid shaped covering 320D (left) having a rectangular shaped plug feature 318 (shown as dotted lines on the inside surface of 320D), an interior cavity (not labeled and not shown), and two mounting slots 321, the first mounting slot in the upper left of the back region 325 (not shown) of the body 310 and the second mounting slot in the upper right of the back region 325 (not shown) of the body 310. The covering 320A is covering the aperture 313A of the body. The covering 320B (not shown) is covering the aperture 313B (not shown) of the body. The description of embodiment 300 will be continued in the section discussing FIG. 5, as FIG. 5 shows many functional parts not visible in FIG. 4.

Figure 5:
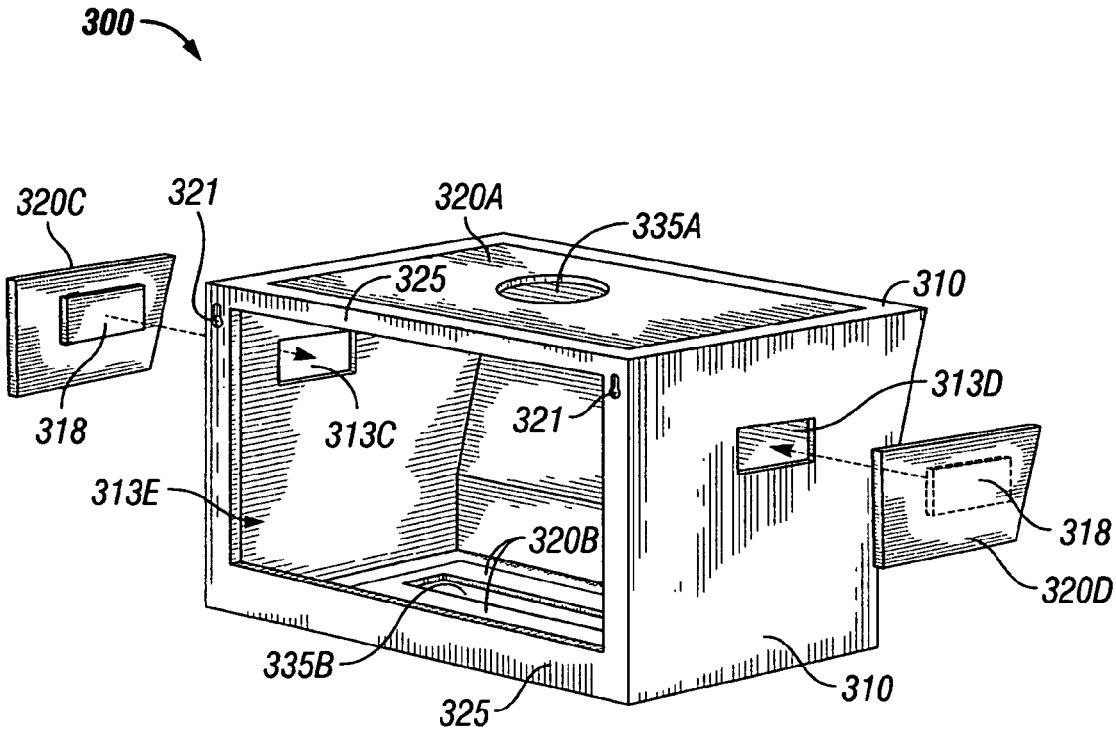
FIG. 5 depicts a back and left perspective view of the preferred embodiment of FIG. 4, in this view, the two right trapezoid-shaped coverings having plug features (left and right) have been retracted to reveal two rectangular-shaped apertures (left and right) in the body, in this depiction, the body has two mounting slots visible on the back side, three apertures of the body visible (right, left, and back), two apertures (upper and lower) of the body not visible, and four coverings visible.

In FIG. 5, a back left perspective view of embodiment 300 of FIG. 4 is depicted, in this view, the back region 325 of the body 310 is visible showing the rectangular aperture 313E (back) and the two mountings slots 321 in the upper corners of the back region 325, the right trapezoid shaped covering 320C (right) with its rectangular shaped plug feature 318 that is made to tightly fit the rectangular shaped aperture 313C (right) is visible, the right trapezoid shaped covering 320D (left) with its rectangular shaped plug feature 318 (shown as dotted lines on the inside surface of 320D) that is made to tightly fit the rectangular shaped aperture 313D (left), the rectangular shaped covering 320B (lower) having a slot shaped aperture 335B in the covering 320B is visible through the aperture 313E (back), and the rectangular shaped covering 320A (upper) having a circular shaped aperture 335A in the covering 320A is visible. The covering 320A is covering the aperture 313A of the body. The covering 320B is covering the aperture 313B of the body. The aperture 313E lacks a covering.

The body 310 has a thin exterior surface and encompasses a large interior cavity (not labeled) that can be easily seen through the aperture 313E (back). The aperture 313E is large to allow better access to the covering 320B and the interior cavity (not labeled). It is not contemplated that aperture 313E will be useful for supporting or arranging products through this aperture.

The mounting slots 321 are part of a means for affixing the body 310 to a support surface. The mounting slots 321 have an enlarged opening on the lower end of the mounting slot that will accept the head of a nail and a slot part on the upper end of the mounting slot that will accept the shank of nail, but not the head of the nail.

Two nails can be partially hammered into the support surface so that the nails have a distance between them equal to the distance between the mounting slots. The mounting slots 321 can be hung on the exposed heads of the nails by placing the enlarged open ends over the heads of nails and lowering the body 310 so that the end of the slot part rest on the shanks of the nails.

The covering 320C has a right trapezoid shape with the acute angle pointing toward the front of the article, the plug feature 318 is on the inside of the covering 320C (left side) and is rectangular shaped and made to fit the rectangular shaped aperture 313C. The covering 320D is a right trapezoid shape with the acute angle pointing toward the front of the article, the plug feature 318 is on the inside of the covering 320D (right side) and is rectangular shaped and made to fit the rectangular shaped aperture 313D.

The covering 320B is rectangular shaped with a slot shaped aperture 335B running right to left. The covering 320B rests on two opposing shelves (not shown) of the body 310. The covering 320B is a little smaller than the aperture 313B in which it resides. The covering 320B is not only a covering, but the product can be wound around the covering 320B before the covering 320 is wedgedly placed on the opposing shelves within the aperture 313B, thus the covering 320B can serve as means for fastening the product to the body.

The covering 320A is rectangular shaped with a circular shaped aperture 335A. The covering 320A fits in the aperture 313A and it also rests on two opposing shelves (not shown) of the body 310. The covering 320A not only blocks the aperture 313A, but it can support other objects on its planar surface.

With its many variable elements, such as aperture shape, covering shape, different numbers of apertures, different styles of coverings, body shapes, body designs, variety of fastening elements, having or lacking an interior cavity, coverings that alter the shape of the apertures, coverings that narrow the apertures, those skilled in the art will appreciate that numerous different embodiments are possible with the disclosed features.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. An article for supporting and arranging products, the article comprising:

a body, wherein the body lacks an interior cavity; wherein the body has three or more apertures, wherein two or more apertures are continuous within the body and at least one aperture in not aligned in the same direction as the direction of the two apertures that are continuous, whereby window treatments may be positioned within the apertures of the body to create an arrangement of the window treatments, and one or more fasteners, wherein the fasteners revocably affix window treatments to the body and the fasteners are disposed within the physical perimeter of the body.

2. The article of claim 1, wherein the body has an interior cavity.

3. The article of claim 1, wherein at least one non-aligned aperture is positioned in a direction that is orthogonal to the direction of at least one other aperture of the body.

4. The article of claim 1, further comprising:

a means for affixing the body to a support surface, wherein the means for affixing the body to a support surface is a physical feature in the body.

5. The article of claim 1, wherein the body is revocably collapsible into a planar configuration.

6. The article of claim 5, further comprising:

one or more braces to prevent the body from collapsing into a planar configuration.

7. An article for supporting and arranging products, the article comprising:

a body; the body having three or more apertures, wherein two or more apertures are continuous within the body, whereby window treatments may be positioned within the apertures of the body to create an arrangement of the window treatments, and one or more planar members disposed within at least one aperture of the body, wherein the planar members are disposed transversely to the direction of the aperture that the planar members occupy, wherein the planar members have at least one aperture that extends completely through each planar member and the aperture of the planar member is in the same direction as the aperture being occupied by the planar member.

8. The article of claim 7, further comprising:

one or more fasteners, wherein the fasteners revocably affix window treatments to the body.

9. The article of claim 7, wherein further comprising:

one or more coverings for the apertures of the body.

10. An article for supporting and arranging products, the article comprising:

a body, the body having three or more apertures, wherein two or more apertures are continuous within the body and at least one aperture is not aligned in the same direction as the direction of the two apertures that are continuous, whereby products may be positioned within the apertures of the body to create an arrangement of the products, wherein the body has a top side, a bottom side, a front side, a back side, a left side, and a right side, and two or more coverings for the apertures of the body, wherein the coverings are revocably affixed to the body wherein the coverings are planar members disposed within at least on aperture of the body, wherein the planar members are disposed transversely to the direction of the aperture that the planar members occupy, wherein the planar members have at least one aperture that extends completely through each planar member and the aperture of the planar member is in the same direction as the direction of the aperture being occupied by the planar member.

11. The article of claim 10, wherein the body has an inner cavity.

12. The article of claim 10, further comprising:

one or more fasteners, wherein the fasteners revocably affix window treatments to the body.

13. The article of claim 10, further comprising:

one or more coverings with a plug feature, wherein the plug feature tightly fits one or more apertures of the body.

14. The article of claim 10, further comprising:

a covering that can support another object.

15. The article of claim 10, further comprising:

one or more coverings with an aperture in the covering.

16. The article of claim 10, further comprising:

one or more coverings with a slot-shaped aperture in the covering.

17. The article of claim 10, further comprising:

a means of affixing the body to a support surface, wherein the means for affixing the body to a support surface is a physical feature in the body.

* * * * *